US006779424B2

(12) United States Patent
Schmidt

(10) Patent No.: US 6,779,424 B2
(45) Date of Patent: Aug. 24, 2004

(54) ELECTRICIAN'S WRENCH

(76) Inventor: Fred William Schmidt, N2643 Sunset Park Dr., Lake Geneva, WI (US) 53147

( * ) Notice: Subject to any disclaimer, the term of this patent is extended or adjusted under 35 U.S.C. 154(b) by 30 days.

(21) Appl. No.: 10/273,385

(22) Filed: Oct. 17, 2002

(65) Prior Publication Data

US 2004/0074346 A1 Apr. 22, 2004

(51) Int. Cl.[7] ..... B25B 13/48; B25B 13/56

(52) U.S. Cl. ..... 81/176.15; 81/124.2; 81/125.1; 81/461.1

(58) Field of Search ..... 81/176.15, 176.2, 81/124.2, 124.7, 125.1, 461.1

(56) References Cited

U.S. PATENT DOCUMENTS

| | | | | | |
|---|---|---|---|---|---|
| 1,752,074 | A | | 3/1930 | Gagne | |
| 2,386,011 | A | | 10/1945 | Stanley | |
| 2,496,591 | A | * | 2/1950 | Maxwell | 29/240 |
| 2,522,038 | A | | 9/1950 | Houghton | |
| 2,575,779 | A | | 11/1951 | Young | |
| 3,161,091 | A | | 12/1964 | Searcy | |
| 3,768,345 | A | * | 10/1973 | Barnes | 81/176.15 |
| 4,848,195 | A | | 7/1989 | Hockenbery | |
| 5,492,040 | A | * | 2/1996 | Bellas | 81/125.1 |
| 5,524,511 | A | | 6/1996 | Taka's | |
| 6,044,732 | A | * | 4/2000 | Astle | 81/176.15 |
| 6,176,157 | B1 | | 1/2001 | Ure | |
| 2001/0022778 | A1 | * | 9/2001 | Ito et al. | 370/242 |

* cited by examiner

*Primary Examiner*—Lee D. Wilson
(74) *Attorney, Agent, or Firm*—Ryan Kromholz & Manion, S.C.

(57) ABSTRACT

A tool for engaging a nut, the nut being configured for engaging an abuting surface and having at least one laterally-extending projection. The tool comprises a base and a plurality of upstanding axially projecting tangs extending from the base for alternatively engaging opposing sides of the laterally-extending projection.

11 Claims, 7 Drawing Sheets

ELECTRICIAN'S WRENCH

FIELD OF THE INVENTION

The invention is generally related to apparatus for engaging a fitting. More particularly, the invention relates to wrench-likes tools for engaging a locknut such as employed with electrical connectors.

BACKGROUND OF THE INVENTION

Locknuts are typically screwed against the end of a pipe fitting or other conduit to hold the latter securely so as to provide an electrical ground. They commonly take the form of a collar having internal threads and may be constructed of various materials (e.g., metal, plastic) and come in a variety of shapes (e.g., hexagonal, square, round) and sizes.

One common application of locknuts is the securing of sections of electrical connectors within electrical junction boxes. A junction box thereby serves to join different runs of raceway or cable and provides space for the connection and branching of the enclosed conductors.

Locknuts used in association with electrical conduit are typically annular metal rings. The locknut includes a threaded inner surface for engaging a complementary threaded outer surface on the electrical connector. A series of projections known as lugs, commonly six or eight, extend radially from the ring. Between the lugs are rounded openings or scallops.

Conventional methods of tightening and loosening or removing locknuts include placing a screwdriver or similar device against one of the lugs and hitting the screwdriver with a hammer. This method, while effective, does not guarantee a tight fitting and has some inherent safety concerns.

One tool for engaging a locknut is disclosed in U.S. Pat. No. 2,522,038, issued to Houghton. Houghten discloses a wrench having a cage connected to a shank with a suitable handle thereon. An annular member is secured to the cage. A plurality of lug extensions extend therefore in spanner wrench fashion. The position of the extensions is such that they fit into the spaces between a pair of lugs of the locknut.

U.S. Pat. No. 2,575,779, issued to Young, discloses an electrician's wrench and reamer having a tool head which includes a pair of spaced prongs that are set apart so as to readily straddle a nut and fit the scallops. Each prong is configured to fit between a pair of adjacent lugs.

U.S. Pat. No. 5,524,511, issued to Taka's, discloses a locknut tool having a C-shaped handle. The handle includes a pair of shoulders that engage a lug when the wrench is fitted over a locknut. The position of the shoulders is such that they fit into the spaces between a pair of lugs of the locknut.

Because they result in only a limited amount of torque, these prior art tools are limited in their ability to tighten or remove a locknut. The need exists for a simple, efficient tool for tightening and removing locknuts.

SUMMARY OF THE INVENTION

One aspect of the invention provides a tool and method for engaging a nut, the nut being configured for engaging an abuting surface and having at least one laterally-extending projection. The tool comprises a base and a plurality of upstanding axially projecting tangs extending from the base for alternatively engaging opposing sides of the laterally-extending projection.

In one embodiment, the base is carried by a wrench. The base can be configured for releasable attachment to a socket wrench. The socket wrench can permit the apparatus to engage the nut in a ratcheting fashion.

Another aspect of the invention provides a tool and method for engaging a nut, the nut being configured for engaging an abuting surface and having at least one laterally-extending projection. The tool comprises a handle and a head carried by the handle and having a plurality of upstanding axially projecting tangs for alternatively engaging opposing sides of the projection.

According to yet another aspect of the invention, a second head is carried by the handle and has a plurality of upstanding axially projecting tangs for alternatively engaging opposing sides of the projection. The first and second heads may be of the same or of different size and configuration. Further, the first and second heads may have the same or different number of upstanding axially projecting tangs.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

I. Tool for Engaging a Locknut

Figure 1:
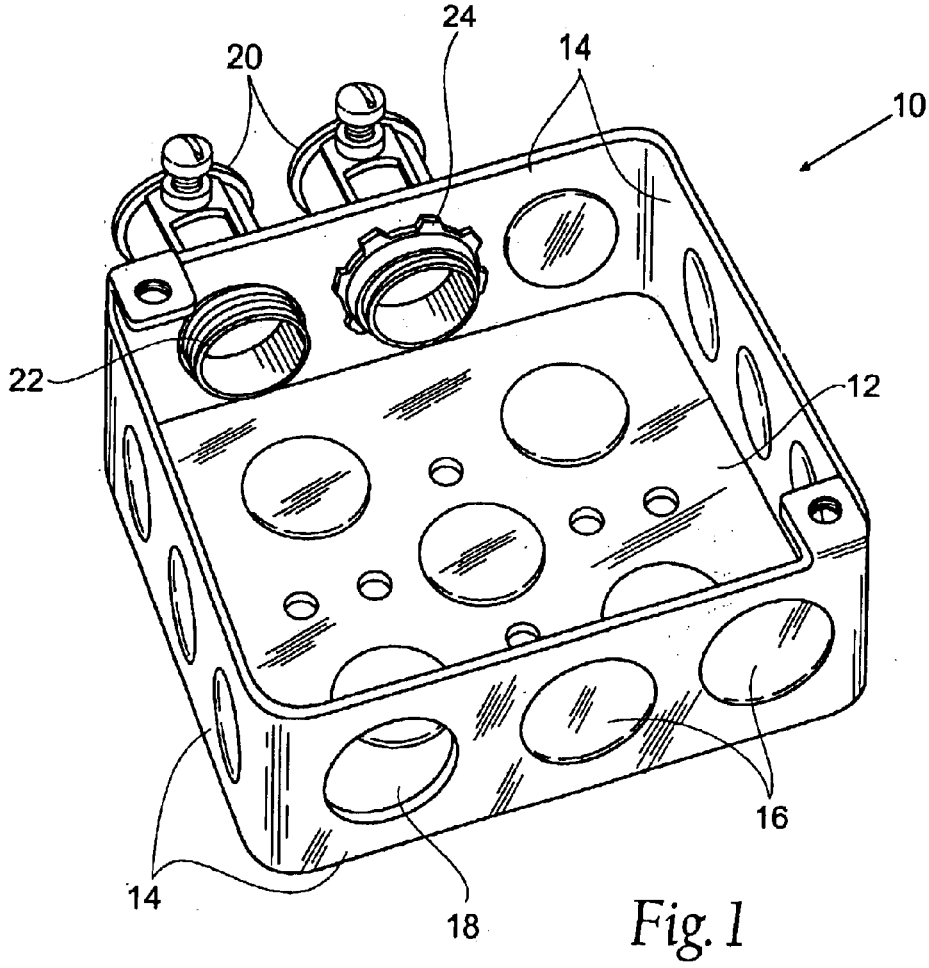
FIG. 1 is a perspective view of an electrical junction box.

FIG. 1 shows a conventional electrical junction box 10 having a bottom wall 12 and four side walls 14. The box 10 includes a series of scored knock-out sections 16 that are well known in the art. Removal of a knock-out 16, e.g., by striking the section with a hammer, results in an opening 18 that permits passage of an electrical connector 20. The number, placement, and configuration of the knock-outs may be varied to accommodate specific needs.

Conventional connectors 20 include a threaded end region 22 sized and configured for passage through the opening 18. Connectors 20 are available in a variety of sizes, e.g., ½ inch diameter, 1 inch diameter.

Figure 2:
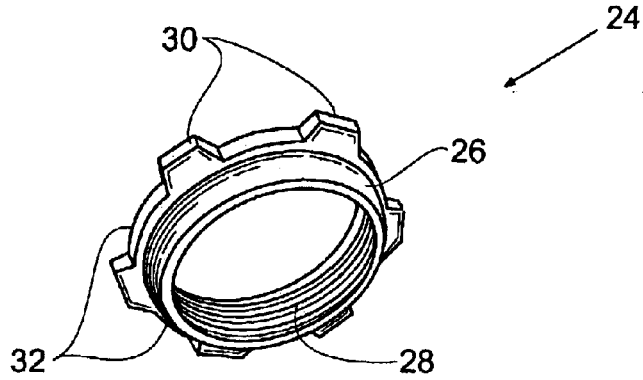
FIG. 2 is a perspective view of a locknut commonly used with electrical connectors.

The connector 20 is typically secured within the junction box 10 by a locknut 24. As seen in FIG. 2, a conventional locknut 24 used for electrical connectors 20 is typically an annular metal ring 26 having a threaded inner surface 28 sized and, configured to mate with the threaded end region 22 of the connector 20 within the junction box 10. Extending from the outer periphery of the ring 26 is a series of projections, or lugs 30. The areas between adjacent lugs 30 define a series of rounded openings, or scallops 32. Locknuts 24 employed with electrical connectors 20 typically have either six lugs 30 (as FIG. 2 illustrates) or eight lugs 30 (not shown) and come in a range of various sizes to accommodate the various sizes of connectors 20, e.g., ½ inch diameter, 1 inch diameter, etc.

It is often difficult to position a pliers or other tool so as to engage the lugs 30 of a locknut 24 sufficiently to tighten or loosen the locknut 24. This is particularly the case in instances in which it is necessary to secure a connector 20 in an opening 18 that is located in a corner of the box 10, as shown in FIG. 1.

Figure 3:
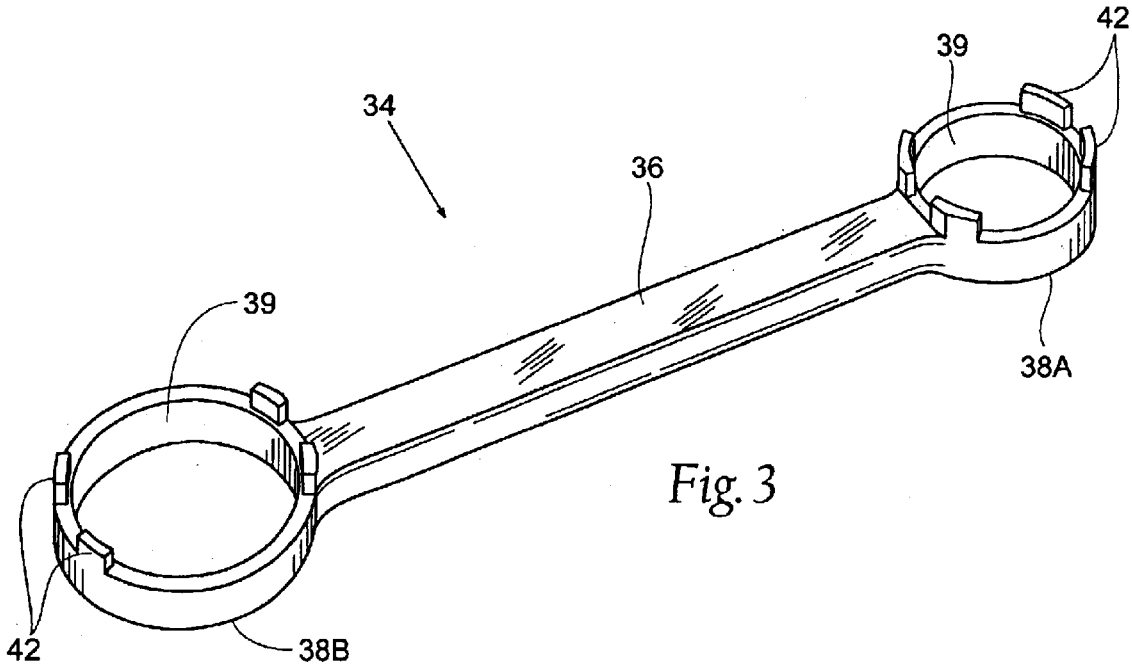
FIG. 3 is a perspective view of a tool embodying features of the invention.

FIG. 3 shows a wrench tool 34 for engaging a locknut 24. The tool 34 is particularly well suited for engaging a locknut 24 such as that used to secure an electrical connector 20, and thus will be described in accordance with such use. However, uses of the tool 34 to engage and secure other fittings are contemplated and will be apparent to those skilled in the art that read this disclosure.

Figure 4:
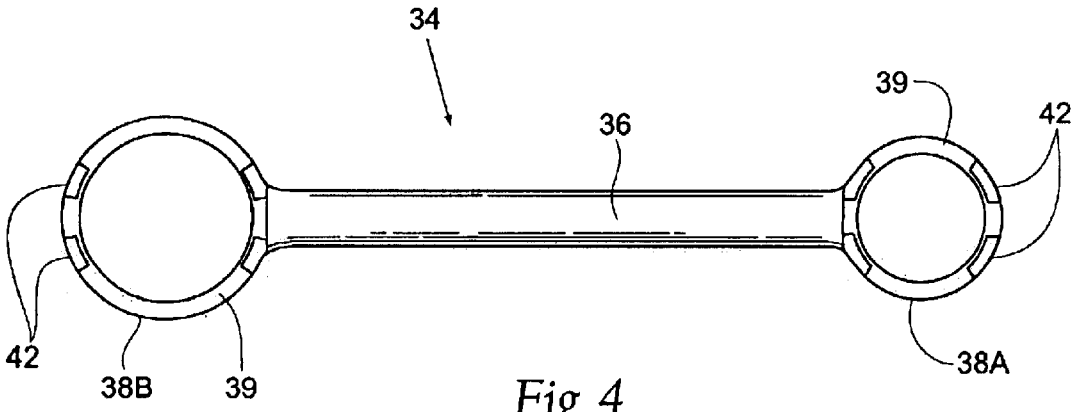
FIG. 4 is a top view of the tool shown in FIG. 3.
Figure 5:
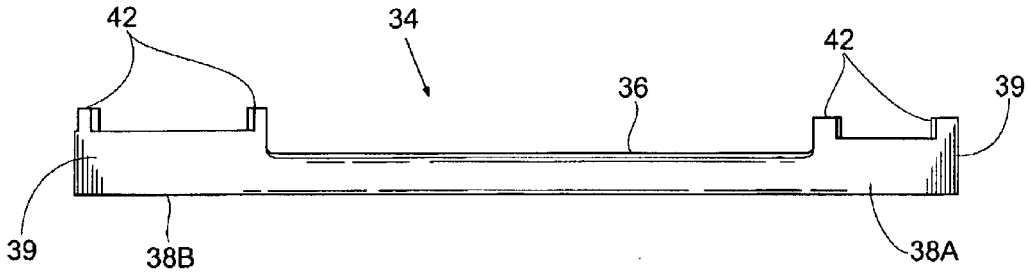
FIG. 5 is a side view of the tool shown in FIG. 3.
Figure 6:
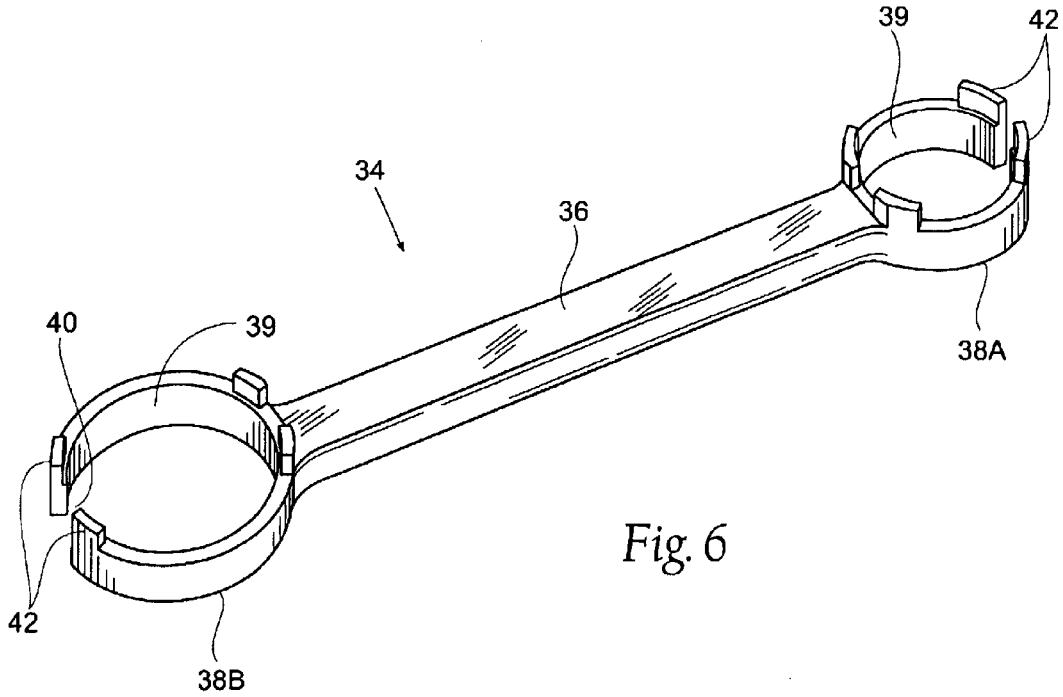
FIG. 6 is a perspective view of an alternative embodiment of a tool embodying features of the invention.

The tool 34 comprises a handle 36 carrying at least one head 38A or 38B. If a preferred embodiment, as seen in FIG. 3, the tool 34 has a first head 38A and a second head 38B extending from opposing ends of the handle 36. The heads 38A and 38B are annular rings 39 sized and configured to have an inner diameter slightly larger than the outer diameter of the ring 26 of a complementary locknut 24. As FIGS. 3–5 show, the first and second heads 38A and 38B may be of different diameters, e.g., the first ring 39A may be of a ½ inch diameter and second ring 39B may by of a 1 inch diameter. It is contemplated, however, that the head 38A or 38B may take forms other than a ring 39, e.g., C-shape crescent wrench configuration or hexagonal (not shown). In one alternative embodiment, shown in FIG. 6, the ring 39 includes an opening or notch 40. The notch 40 permits electrical wires to pass through the head 38A or 38B. It is to be understood that the first and second heads 38A and 38B may be of the same of different configurations, e.g., first head 38A is of a ring configuration and second head 38B is of a hexagonal configuration.

Extending from the ring is a series of projections or tangs 42. The tangs 42 can be arranged in pairs and configured to rest in adjacent scallops 32 to engage opposing sides of a lug 30. In this arrangement, movement of the head 38A or 38B in a first direction (e.g., clockwise) applies force to one side of the lug 30 to move the locknut 24 in a first direction (e.g., tightens the locknut 24). Movement of the head 38A or 38B in the reverse direction (e.g., counterclockwise) applies force to the opposite side of the same lug 30 to move the locknut 24 in a second direction (e.g., loosens the locknut 24). Desirably, there is at least two pair of tangs 42. The pairs can be variously spaced from one another to accommodate locknuts 24 having varying number of lugs 30. In the embodiment illustrated in FIGS. 3–5, the pairs are spaced 180° apart, thereby accommodating a locknut 24 having either six or eight lugs 30.

Figure 7:
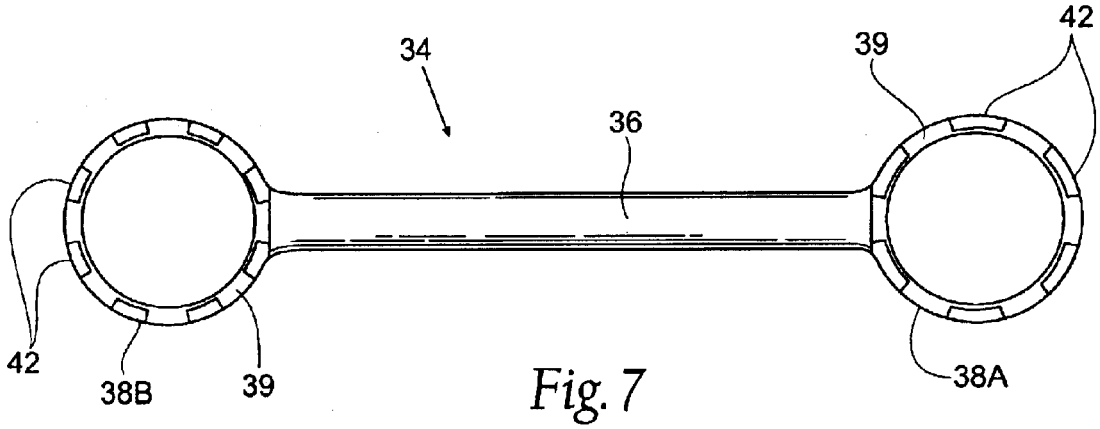
FIG. 7 is a top view of an alternative embodiment of a tool embodying features of the invention.

In an alternative embodiment, tangs 42 extend circumferentially around the heads 38A and 38B, thereby providing a greater amount of torque. The number and configuration of the tangs 42 can be varied to accommodate varying number of lugs 30. For example, FIG. 7 illustrates an embodiment in which the first head 38A includes six tangs 42 configured to engage a locknut 24 having six lugs 30 and the second head 38B includes eight tangs 42 configured to engage a locknut 24 having eight lugs 30.

Figure 8:
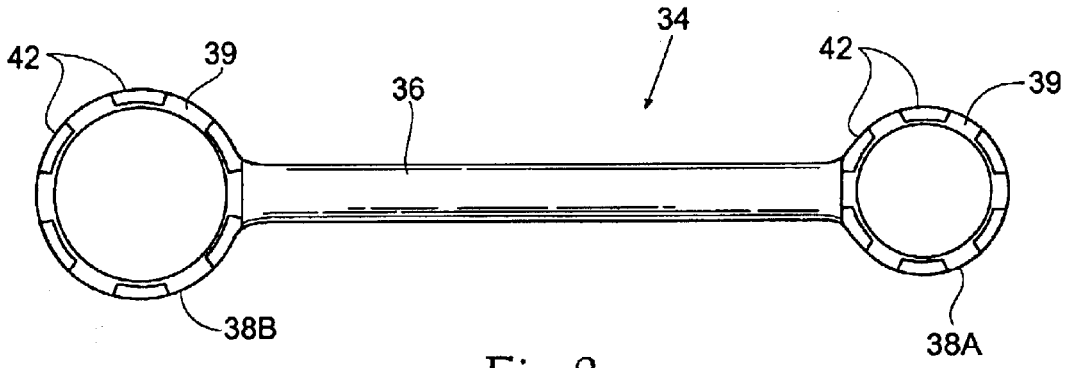
FIG. 8 is a top view of an alternative embodiment of a tool embodying features of the invention.

As previously noted, the first and second heads 38A and 38B may be of the same diameter or size or of different diameters or sizes. FIG. 8 illustrates an arrangement in which the first and second heads 38A and 38B both include six tangs 42, but the first head 38A is of one diameter (e.g., ½ inch) and the second head 38B is of a different diameter (e.g., 1 inch). It is to be understood that by varying the size and configuration of the heads 38A and 38B and the number of tangs 42, the tool 34 can be customized to accommodate virtually any locknut 24.

The tool 34 may be made of steel, a combination of steel and plastic, or other suitable materials and formed by mold, die, or machining.

Figure 9:
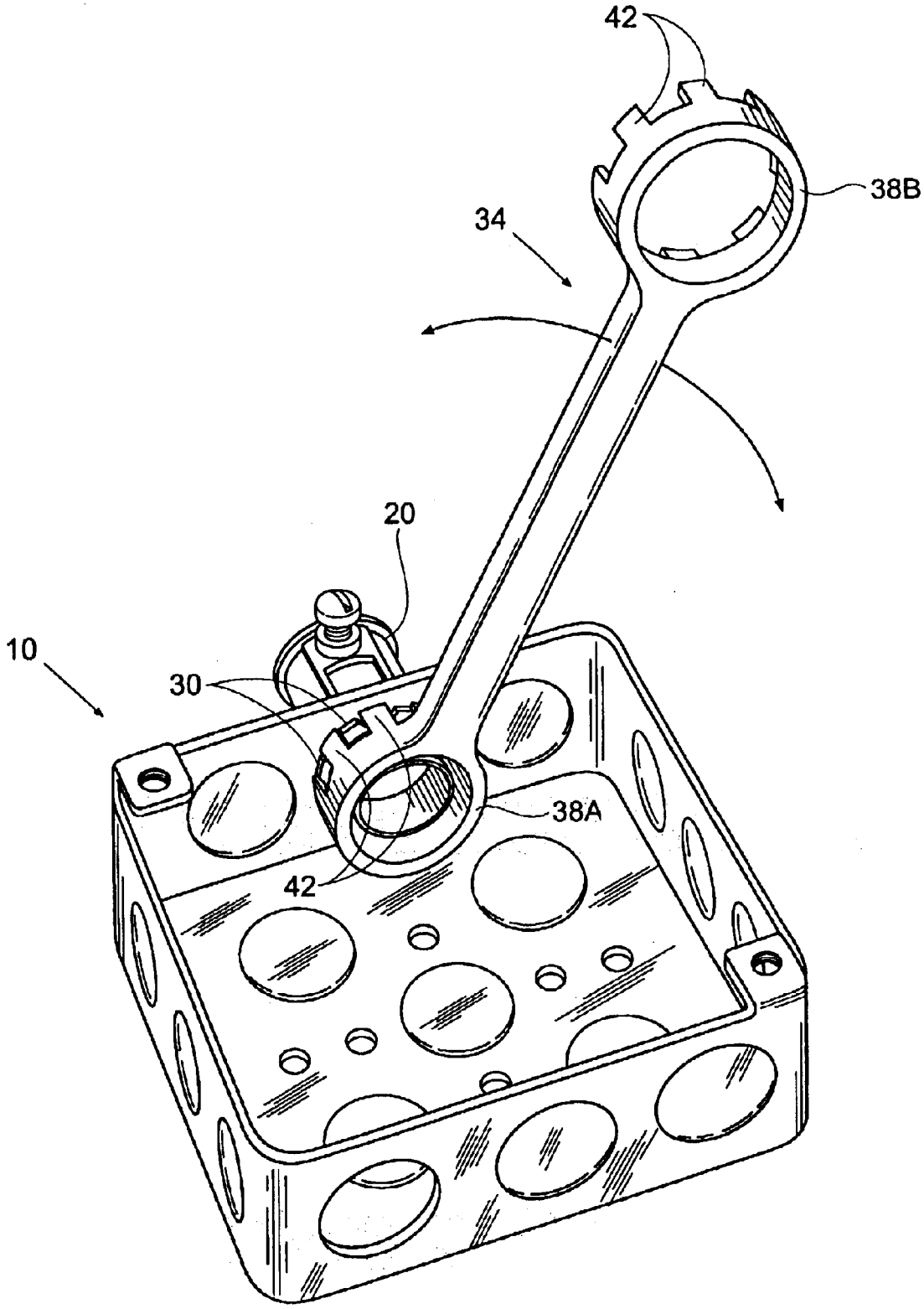
FIG. 9 is a perspective view illustrating use of the tool shown in FIG. 8 to engage a locknut on a connector within an electrical junction box.

In use, a connector 20 is placed within an opening 18 in a junction box 10. A locknut 24 is placed on the threaded end region 22 of the connector 20. As illustrated in FIG. 9, a tool 34 having a head 38A or 38B that is complementary to the locknut 24 (i.e., in diameter of the head 38A or 38B and number of tangs 42) is then positioned to engage the locknut 24. The handle 36 is then manipulated to rotate the locknut 24 in a first direction (e.g., clockwise) to tighten the locknut 24. The locknut 24 may then be rotated in the opposite direction (e.g., counterclockwise) to loosen and remove the locknut 24.

II. Alternative Embodiment

Figure 10:
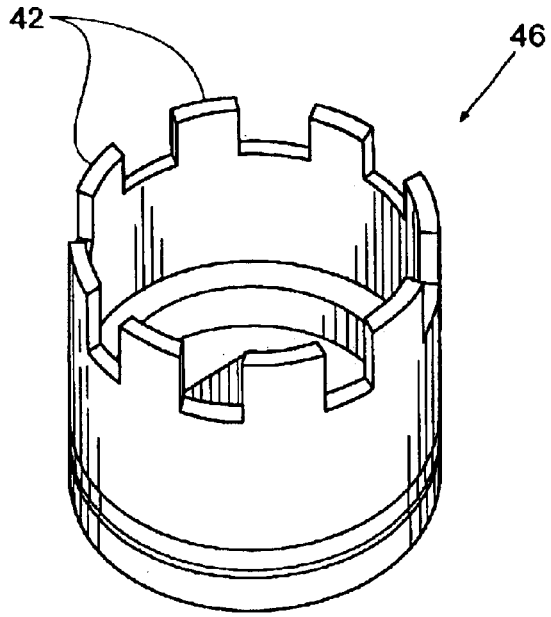
FIG. 10 is a perspective view of an alternative embodiment of a tool embodying features of the invention.
Figure 11:
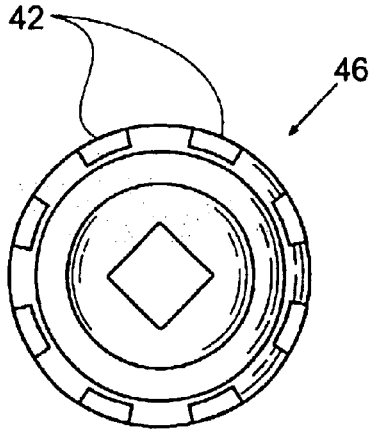
FIG. 11 is a top view of the tool shown in FIG. 10.
Figure 12:
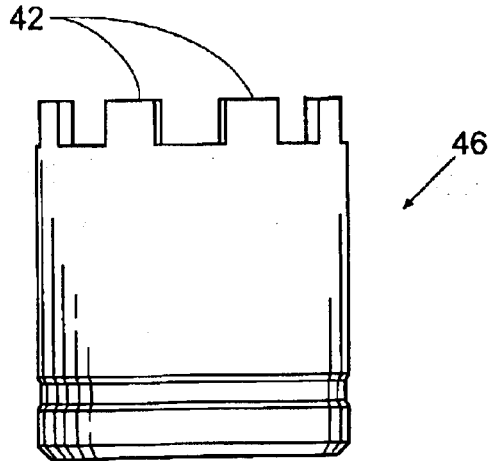
FIG. 12 is a side view of the tool shown in FIG. 10.
Figure 13:
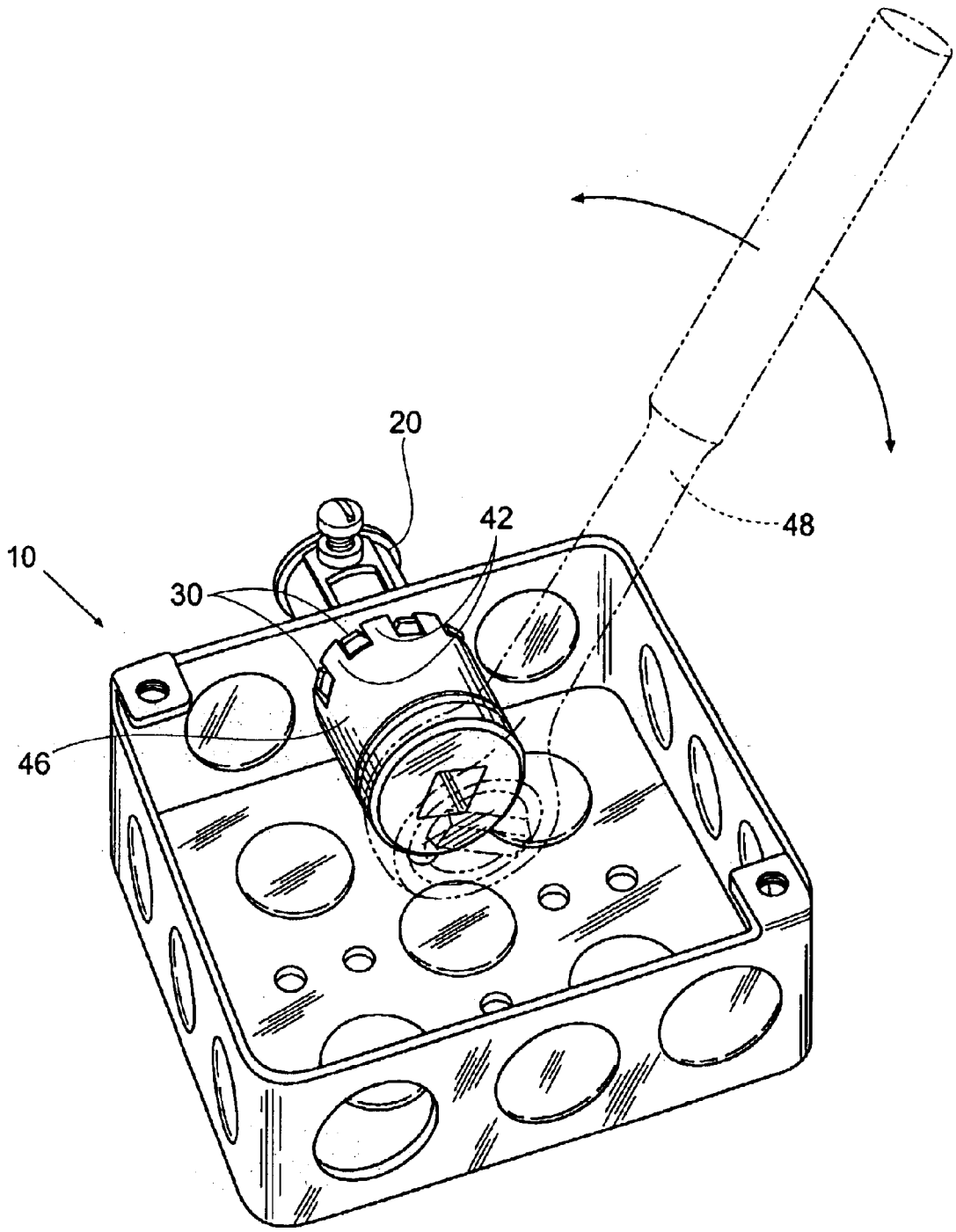
FIG. 13 is a perspective view illustrating use of the tool shown in FIG. 12 to engage a locknut on a connector within an electrical junction box.

FIGS. 10–12 illustrate a socket tool 46 embodying features of the invention. Similar to the embodiment of FIGS. 3–5, the socket 46 may be variously sized and configured and includes a plurality of tangs 42 configured to rest in adjacent scallops 32 to engage opposing sides of a lug 30. The socket 46 is sized and configured to couple to a conventional socket wrench 48, as shown in FIG. 13. The tool 46 may be made of steel or other suitable materials and formed by mold, die, or machining.

This arrangement permits the socket tool 46 to be rotated in a ratcheting fashion. The ratchet motion is particularly desirable in a junction box, where space for manipulating a wrench handle is limited.

With continued reference to FIG. 13, the connector 20 is placed within an opening 18 of the junction box 10 and a locknut 24 is placed on the connector 20, as previously described. A socket tool 46 that is sized and configured complementary to the locknut 24 is coupled to the socket wrench 48. It is to be understood that by varying the size of the configuration of the socket 46, as well as the number and position of tangs 42, the tool 46 can be customized to accommodate virtually any locknut 24. The tool 46 is then placed over the locknut 24 with the tangs 42 positioned to engage the locknut 24. The wrench 48 is then manipulated to rotate the locknut 24 to tighten or loosen the locknut 24, as also previously described.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A tool for engaging a nut, the nut configured for engaging an abuting surface and having at least one laterally-extending projection, the tool comprising a handle;

a first head connected to the handle and having a plurality of upstanding axially projecting tangs for alternatively engaging opposing sides of the projection, and a second head carried by the handle and having a plurality of upstanding axially projecting tangs for alternatively engaging opposing sides of the projection, wherein at least one of the first and second heads is an annular ring.

2. The tool as in claim 1 wherein the ring includes an opening.

3. The tool as in claim 1 wherein the first head and the second head are of the same diameter.

4. The tool as in claim 1 wherein the first and second heads are of different diameters.

5. The tool as in claim 1 wherein the first and second heads are of the same configuration.

6. The tool as in claim 1 wherein the first and second heads are of different configurations.

7. The tool as in claim 1 wherein the first and second heads have the same number of upstanding axially projecting tangs.

8. The tool as in claim 1 wherein the first and second heads do not have the same number of upstanding axially projecting tangs.

9. A method of engaging a nut, the nut configured for engaging an abuting surface and having at least one laterally-extending projection, comprising providing a tool comprising a handle and a first head and a second connected to the handle, the first and second heads each having a plurality of upstanding axially projecting tangs for alternatively engaging opposing sides of the projection, at least one of the first and second heads being an annular ring, selecting the first or second head, positioning the selected head to engage the nut, and manipulating the tool to adjust the position of the nut.

10. The method of claim 9 wherein the nut is loosened.

11. The method of claim 9 wherein the nut is tightened.

* * * * *